US011117186B2

(12) United States Patent
Price

(10) Patent No.: US 11,117,186 B2
(45) **Date of Patent: *Sep. 14, 2021**

(54) POWDER INVESTMENT CASTING BINDER AND MOLDS DERIVED THEREFROM

(71) Applicant: IC Ceramic Consulting, LLC, Weare, NH (US)

(72) Inventor: David B. Price, Weare, NH (US)

(73) Assignee: IC Ceramic Consulting, LLC, Weare, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/722,066

(22) Filed: Dec. 20, 2019

(65) Prior Publication Data

US 2021/0086255 A1 Mar. 25, 2021

Related U.S. Application Data

(60) Provisional application No. 62/905,541, filed on Sep. 25, 2019.

(51) Int. Cl.
*B22C 1/22* (2006.01)
*B22C 7/02* (2006.01)
*B22C 9/12* (2006.01)

(52) U.S. Cl.
CPC ..... *B22C 1/2293* (2013.01); *B22C 1/2286* (2013.01); *B22C 7/02* (2013.01); *B22C 9/12* (2013.01)

(58) Field of Classification Search
CPC ..... B22C 1/2293; B22C 1/2286; B22C 1/00; B22C 1/02; B22C 1/08; B22C 1/14; B22C 7/00; B22C 7/02; B22C 9/12; B22C 9/043
See application file for complete search history.

(56) References Cited

U.S. PATENT DOCUMENTS 4,019,558 A 4/1977 Szabo
4,508,835 A 4/1985 Kaniuk et al.
(Continued)

FOREIGN PATENT DOCUMENTS

JP 05076989 A 3/1993
KR 20010104587 A 11/2001

OTHER PUBLICATIONS

Office Action for U.S. Appl. No. 16/900,169, dated Sep. 21, 2020, 19 Pages.

(Continued)

*Primary Examiner* — Kevin P Kerns
*Assistant Examiner* — Steven S Ha
(74) *Attorney, Agent, or Firm* — Maine Cernota & Rardin

(57) ABSTRACT

A powder binder product for use in making a slurry for investment casting molds comprising Nano-sized powders; and an organic polymer powder, wherein it does not require aqueous colloidal silica to produce slurries used to build investment casting molds. The Nano-sized powders comprise fumed alumina, boehmite, fumed silica, or fumed titanium oxide or combinations thereof. The coarse refractory powder, combined with the powder binder for mold manufacture, comprises milled zircon, tabular alumina or fused alumina, fused silica, alumino-silicate, zirconia, and yttria or combinations thereof. The organic polymer in a powder binder comprises a cellulose-based material. A powder investment casting binder, that once fired, consists of up to 96 weight percent aluminum oxide.

18 Claims, 6 Drawing Sheets

COLLOIDAL SILICA IN 55-GALLON DRUMS AND EQUIVALENT POWDER BINDER

(56) References Cited

U.S. PATENT DOCUMENTS

| | | | | |
|---|---|---|---|---|
| 5,465,780 | A | 11/1995 | Muntner | |
| 6,949,136 | B2 | 9/2005 | Horton | |
| 8,087,450 | B2 | 1/2012 | Nycz | |
| 9,227,241 | B2 | 1/2016 | Bhattacharja | |
| 2011/0114279 | A1 | 5/2011 | Scott | |
| 2011/0232857 | A1* | 9/2011 | McGuire | B22C 9/04 164/519 |
| 2012/0111224 | A1 | 5/2012 | Tontrup | |
| 2015/0158076 | A1 | 6/2015 | Bochiechio | |
| 2018/0117668 | A1 | 5/2018 | Price | |

OTHER PUBLICATIONS

International Search Report and Written Opinion for PCT Appl. No. PCT/US20/052499, dated Jan. 13, 2021, 13 Pages.

* cited by examiner

100

COLLOIDAL SILICA IN 55-GALLON DRUMS AND EQUIVALENT POWDER BINDER

200

FUSED SILICA MOLDS PRODUCED WITH POWDER BINDER (A)
AND KNOWN STATE-OF-THE-ART COLLOIDAL SILICA (C)
EACH FLASH-FIRED AT 815 DEG. C

300

(A) (C)

CASTINGS PRODUCED WITH POWDER BINDER (A) AND
KNOWN STATE-OF-THE-ART COLLOIDAL SILICA (C)
A356 ALUMINUM POURED INTO A 287 DEG. C PREHEATED MOLD

400

FLEXURAL CREEP WITH POWDER BINDER (A) AND STATE-OF-THE-ART COLLOIDAL SILICA (C) BOTH WITH THE SAME ALUMINOSILICATE REFRACTORIES

500

THERMAL EXPANSION CURVES, WITH AND WITHOUT COLLOIDAL SILICA, AND TITANIUM OXIDES

600

METHOD

POWDER INVESTMENT CASTING BINDER AND MOLDS DERIVED THEREFROM

RELATED APPLICATIONS

This application claims the benefit of U.S. Provisional Application No. 62/905,541 filed Sep. 25, 2019. In addition, this application is related to U.S. Provisional Application No. 62/414,437 filed Oct. 28, 2016, and U.S. Utility application Ser. No. 15/795,557, filed Oct. 27, 2017. Each of these applications is herein incorporated by reference in their entirety for all purposes.

FIELD OF THE DISCLOSURE

Embodiments relate to the field of investment casting, and more particularly, to colloidal oxide powders for investment casting binders, and a process for producing a casting mold, and also a casting mold which can be obtained by this process.

BACKGROUND

Investment casting is a type of precision casting for metals, also known as the lost wax process. A pattern model identical to the desired workpiece to be produced is initially made from wax or other materials. Multiple patterns produced by wax injection may be joined to other wax pieces to create a so called "wax assembly". The "wax assembly" goes through a sequence of shell-build operations to encase the pattern in mold material and remove the original (wax) pattern model. Molten metal is then poured into the fired and pre-heated mold to produce the rough casting of the desired work-piece. Tight dimensional control throughout the process is essential to yield a so called 'near-net-shape' casting requiring minimal machining.

Typically, the shell-build process requires two types of slurry so called "prime" and "backup". The prime slurry, used for the first, and/or second coats, consists of finer particle-size refractory powder, typically −325 mesh refractory powder, and aqueous colloidal sol with organic polymer. Prime slurries have high solids content and need to have rheological characteristics to produce a uniform coating to replicate all of the pattern detail in the mold and casting. Typically, the "prime slurry" contains surfactants to allow wetting of the slurry on the pattern and antifoam emulsion to reduce surface tension and minimize entrapped air and facilitate efficient mixing of the slurry raw materials. The "backup" slurry consists of coarser powder, typically −200 and or −120 mesh refractory powder, aqueous colloidal sol with organic polymer at lower solids content and is used for all coats except the first or second coats. After each slurry and stucco combination (referred to as a coating) is applied, a drying operation is performed in a temperature and humidity controlled environment to prepare for the next coating until all coats are applied. Use of organic polymer in slurries, introduced to the investment casting industry in the mid 1980's, provides essential plasticity and toughness to the coatings during the drying and "dewax" operations. Prior to the use of polymer, colloidal silica alone (which forms a water insoluble bond), provided the strength throughout all the shell-build operations; dipping, drying, "dewax", firing, and casting. Historically, colloidal silica has played a key role for producing ceramic shell molds in the investment casting industry.

The so called "dewax" operation is performed by steam autoclave or flash-fire to remove the wax and pattern material. Flash-fire, introduced in the 1990's by Pacific Kiln, performs both dewax and mold firing simultaneously. The resultant mold from either method must yield a clean mold cavity free of all residue, with a smooth hard surface. Firing is typically performed in the 1,800 to 2,000 deg F. range. After preheating of the mold, molten metal is then poured into the mold cavity and solidified. Finally, the raw casting is obtained by removal of the ceramic mold material. Shell removal can be accomplished by impacting the cast runners with a hammer or by waterblast.

Known methods for slurry formulation use colloidal silica (a stable dispersion of silicon oxide particles), alumina, zirconia or yttria sol with particles less than 300 nm in size in a continuous aqueous medium. Aqueous colloidal silica, nominally 30% solid and balance water, is used in a variety of grades; small particle, large particle, and polymer enhanced. Colloidal silica has been the preferred binder for precision investment casting since ethyl silicate was phased out in the 1980's. Colloidal silica does have some favorable characteristics. Colloidal silica forms a permanent bond to itself that is ideal for dipping, drying, steam autoclave, and strength at high temperatures. Colloidal silica particles sinter and bind the refractory particles together. This provides the needed mechanical strength for dipping, drying, dewax, and casting operations. As a result, colloidal silica is the binder of choice in the majority of precision investment casting foundries.

However, there is a pressing need to reduce the carbon footprint for manufactured products. Any weight and volume reduction for essential raw materials like investment casting refractory raw materials reduces both carbon emissions and shipping cost for manufacturers. The ability to manufacture equivalent or superior products is a benefit to manufacturers and society as a whole. Going forward, the need to reduce greenhouse gases will only increase as all major manufacturing countries of the world strive to reduce CO and $CO_2$ gaseous emissions associated with global warming.

Silica-free binder mold face-coats would also be a huge benefit for casting reactive metals like titanium alloys. Titanium alloys provide weight savings, performance, and fuel efficiency enhancement for aircraft engine manufacturers. The reference "Effect of Mold Material and Binder on Metal-Mold Interfacial Reaction for Investment Casting of Titanium Alloys" by Kim teaches the negative effects of using colloidal silica binders for titanium. Therefore, it is well known in industry that silica binder reacts with elements like titanium, hafnium, yttrium, and aluminum and can lead to oxide inclusions or a case-hardened surface. The latter adds greatly to the cost of manufactured products in this category.

$$Ti_{(liq.)}+SiO_{2(solid)}\rightarrow TiO_{2(solid)}+Si$$

The 'case', hardened and brittle surface layer, developed during casting must be removed by a special high-temperature chemical soaking operation. Additionally, oxide inclusions can become flaws that initiate premature failure. So, manufacturer suppliers of components realize customer tolerance for imperfections in aerospace industries is basically non-existent. For this reason, precision investment casting processes need the highest quality raw materials to produce flawless products.

While molds made from colloidal-silica-bonded slurry can produce quality cast articles, there are many drawbacks and consequences. Initially, bulky transport is required for the aqueous sol binder. The environment must be controlled to prevent freezing and degradation. The stability of colloidal silica has many factors including pH, particle size, silica concentration, and storage temperature. Sols should be stored at 5-35° C. (40-95° F.). If the sol is subjected to freezing conditions, it can lose its stability and precipitate. Highly elevated temperatures may accelerate the growth of micro-organisms and/or decrease the long-term stability of the silica sol. pH ranges are very important to the stability of the sol. For example, if the pH of the "prime" slurry approaches 9.2, the binder starts to gel and should not be used in that state to manufacture molds. "Ostwald ripening" leads to agglomeration of the very small silica particle dispersions and the surface area will slowly decrease. The latter results in a critical reduction in strength of colloidal silica bonded molds. That is why companies have dedicated laboratories and technicians to regularly confirm the quality of the colloidal silica binder in the production slurries. Silica concentration is also very important for stability. The more concentrated a sol, the more likely the particles will be forced together and allowed to aggregate. Stability generally determines the shelf life of a sol. Checking sol stability involves performing an 'oven gel test' which requires 24 hours to perform. Either production has to be suspended during that period, or production continues under a cloud of suspicion. As evidenced above, even with transportation and storage capabilities, shelf life monitoring, the gelling of the binder creates an atmosphere of doubt and risk associated with colloidal silica-bonded molds used to produce precision castings. Furthermore, even if skilled technicians determine the binder in a slurry has gelled, it is unknown how much product is at risk because of the 24-hour period needed to test the binder by the 'oven gel test'.

Regarding alternatives to molds produced with silica sols, it is common knowledge that non-silica sol bonded molds must be dewaxed by flash-firing, as they break down in a steam autoclave dewax. Colloidal zirconia, yttria, and alumina are common presently commercially available options for low reactive prime coats. Particles of these oxides do not bond to each other. Those products are nearly 100% pure, and require very high temperatures to develop sinter-bonding with those products. Therefore, it is on this basis that these oxides are not used in industry today in backup slurry, and only rarely in prime slurry for reactive alloy casting. Furthermore, it is common for foundries to heat the mold to extremely high temperatures, in excess of 1200 deg. C., for single crystal casting as an example. Such conditions cause creep distortion of the mold, poor casting dimensional control, and high strength of the mold leading to residual stress-related defects in the casting. Since colloidal silica is used exclusively in backup slurries throughout aerospace investment casting, the latter problems have remained unchecked for decades. The possibility of silica-free binder in backup slurries could yield a water-shed of benefit in aerospace investment casting.

Presently, aqueous colloidal silica is used in some way throughout the investment casting industry. Furthermore, transport of colloidal silica must be done under temperature-controlled conditions, and during winter months stored in a heated warehouse. A way to produce investment casting molds without transporting water and storing water would significantly reduce the energy and cost associated with colloidal silica, or any aqueous oxide sol binder for that matter.

What is needed is a dry, reduced silica, powder material which, when combined with water, forms a colloidal oxide sol, is then used to form a refractory investment slurry (both prime and backup), that produces molds for castings having accurate dimensions, that avoid cracks and settling away, and maintains structural integrity during dewax, while reducing transportation, storage, and preparation costs associated with aqueous colloidal silica binder. The dry powder, and slurries produced therefrom, needs to fit within the present operations and processes without causing major disruption that would result in inconvenience and major equipment changes by precision casting manufacturers.

SUMMARY

An embodiment provides a powder binder product for use in making a slurry for investment casting molds comprising Nano-sized powders; and an organic polymer powder; wherein the composition of the Nano-sized powder comprises boehmite or pseudo boehmite; aluminum oxide; silicon oxide; or titanium oxide; and combinations thereof. In embodiments the composition of the Nano-sized powder comprises pseudo boehmite; aluminum oxide; titanium oxide; and combinations thereof. In other embodiments, the Nano-sized powder is less than 1.2 μm. In subsequent embodiments the organic polymer is between 2.0 and 6.0% by weight of the total powder binder mass. For additional embodiments the organic polymer comprises at least one of a cellulose-based material or acrylic combined with polyethylene glycol. In another embodiment, the organic polymer comprises a cellulose-based material or acrylic combined with polyethylene glycol; and a methyl cellulose binder. A following embodiment, when fired, comprises up to 96 weight percent crystalline aluminum oxide and not less than 70 weight percent. In subsequent embodiments a mold manufacture comprises the powder binder wherein sizes of particles of a coarse refractory powder are −325 mesh; −200 mesh; and −120 mesh; and combinations thereof. In additional embodiments the Nano-sized powder component comprises particles less than about 1.2 μm. Included embodiments, when dispersed in deionized water and buffered to between 3.0 and 5.0 pH, produce an aqueous sol to produce investment casting molds. Yet further embodiments, once used to produce molds, yield molds subsequently dewaxed by flash-fire. Related embodiments do not comprise aqueous colloidal silica to produce slurries used to build investment casting molds.

Another embodiment provides a method for producing an investment casting comprising obtaining a dry powder; obtaining water and buffering the water; combining the dry powder and the buffered water to form a slurry or sol only; adjusting the pH of the slurry; providing a pattern; applying the slurry with a stucco to the pattern to create a mold; allowing the mold to harden; removing the pattern from the mold; filling the mold with molten casting material; allowing the casting material to solidify; and removing the mold from a cast article. Further embodiments comprise the investment casting mold obtained in a process comprising the powder binder product and the method. In ensuing embodiments the dry powder comprises fumed alumina, boehmite, fumed silica, or fumed titanium oxide or combinations thereof; aluminum oxide, zircon, mullite, aluminosilicate, zirconium oxide, yttrium oxide, silicon oxide, and combinations thereof; and (the latter are added as −325 and −120 flours to make the slurry); and a cellulose-based material. For yet further embodiments, the step of obtaining water and buffering the water comprises adding nitric acid to a pH between about 3.0 and about 5.0. For more embodiments, the step of adjusting pH of the slurry comprises a slurry pH range of about 3.5 to about 5.0. Continued embodiments include the step of removing the pattern from the mold comprising flash-fire. Additional embodiments comprise a Nano-sized powder comprising boehmite or pseudo boehmite, aluminum oxide, silicon oxide, or titanium oxide, and combinations thereof; an organic polymer powder; and a coarse refractory powder comprising aluminum oxide, zircon, mullite, alumino-silicate, zirconium oxide, yttrium oxide, fused silicon oxide, and combinations thereof.

A yet further embodiment provides A method for producing an investment casting comprising obtaining a dry powder binder comprising fumed alumina, boehmite, fumed silica, or fumed titanium oxide or combinations thereof, and aluminum oxide, zircon, mullite, alumino-silicate, zirconium oxide, yttrium oxide, silicon oxide, and combinations thereof, and a methylcellulose cellulose-based material; obtaining (deionized) water and buffering the deionized water with nitric acid to a pH between about 3.0 and about 5.0; combining the dry powders and the buffered water to form a slurry; adjusting pH of the slurry as-needed to an about 3.5 to about 5.0 range; providing a pattern; applying the slurry with a stucco to the pattern to create a mold; allowing the mold to harden; removing the pattern from the mold by flash-fire; firing the mold to between 1,000 and 1,200 deg. C; filling the mold with molten casting material; allowing the casting material to solidify; and removing the mold from a cast article.

Embodiments include a combination of colloidal oxide powders consisting, of at least one oxide composition to be dispersed in water, and to produce an aqueous sol suitable to produce investment casting molds.

In embodiments, the composition of the colloidal oxide powders consists of aluminum, silicon, and titanium oxides.

In embodiments the aluminum oxide, of the powder, can be added as boehmite or fumed aluminum oxide.

For further embodiments the organic polymer consists of a cellulose or acrylic based organic polymer.

In other embodiments the range of aluminum oxide is between 65 and 100%, silicon oxide 0 and 35%, and titanium oxide 0 and 2%.

Another embodiment comprises a combination of colloidal oxide powders and combined with a powder organic polymer binder which can be dispersed in buffered deionized water, between pH 2 and 5, to produce an aqueous sol suitable for investment casting mold manufacture.

Another embodiment comprises a combination of colloidal oxide powders which can be dispersed in buffered deionized water, between 2 and 5, which, when an aqueous acrylic binder, is added to produce an aqueous sol suitable for investment casting manufacture.

An embodiment comprises a combination of powders, which when used for investment casting mold manufacture, requires 25% the mass of state-of-the-art aqueous colloidal silica.

An embodiment comprises a combination of powders, including coarse refractory, and buffered deionized water to produce prime and back-up slurry for investment casting manufacture.

An embodiment provides a combination of powders, which when used to manufacture investment castings, yields cast product the quality level of which matches or exceeds that of state-of-the-art colloidal silica.

Embodiments comprise a formulation, which when fired to a temperature between 1,000 and 1,200 deg. C., produces a mold with mechanical properties suitable for investment casting mold manufacture.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention. For purposes of clarity, not every component may be labeled in every drawing.

These and other features of the present embodiments will be understood better by reading the following detailed description, taken together with the figures herein described.

DETAILED DESCRIPTION

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes, and not to limit in any way the scope of the inventive subject matter. The invention is susceptible of many embodiments. What follows is illustrative, but not exhaustive, of the scope of the invention.

Advantages of embodiments: 1) Cost savings for shipping; not shipping water, and no need for temperature control during shipping and storage as required for colloidal silica. 2) Simplicity of use by the end user, just add water, fewer materials to source and inventory. 3) Less reaction between the metal and mold surface, easing shell removal, and improving the surface finish of the casting. 4) The ability to employ both Nano-sized silica and aluminum oxides in "backup" slurries to improve high temperature dimensional stability of the mold and casting. 5) Powder binder can be used in both prime and backup slurry. 6) Higher firing temperatures can be employed since the composition of the self-bonded refractory is more stable than colloidal silica at high temperatures.

Figure 1:
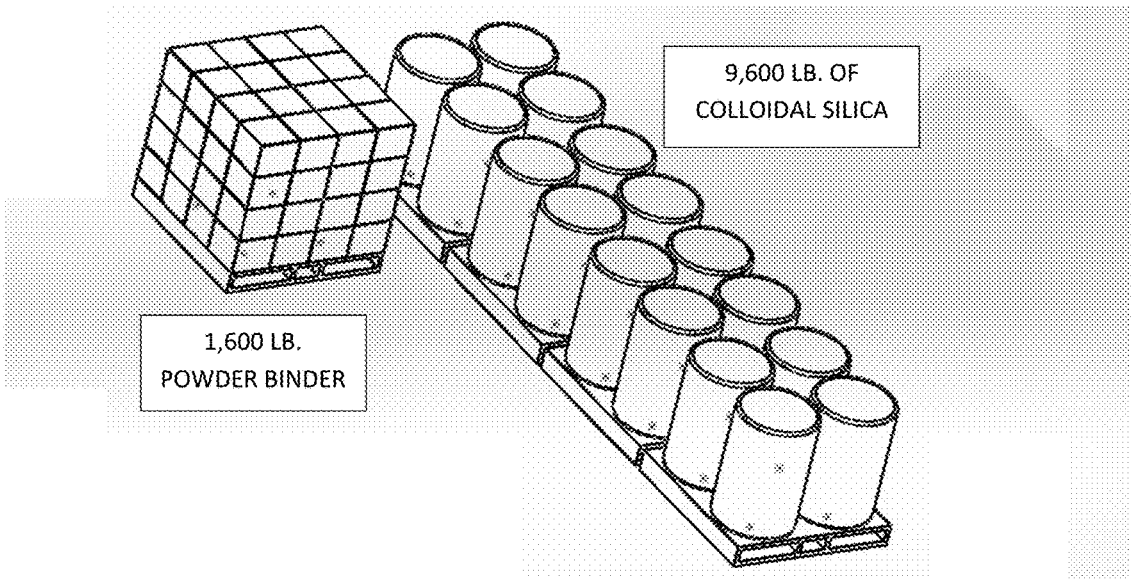
FIG. 1 illustrates the weight and volume difference between aqueous colloidal silica and a powder equivalent in accordance with an embodiment.

FIG. 1 illustrates the weight and volume difference 100 between aqueous colloidal silica and a powder equivalent.

Table 1 illustrates the essential constituents and percentages within the embodiment.

TABLE 1

| Powder Binder Formulation | | |
|---|---|---|
| Raw material | Minimum | Maximum |
| Powder Boehmite | 71.0% | 94.0% |
| Fumed silica | 2.5% | 23.0% |
| Fumed Titania | 0.4% | 1.0% |
| Cellulose binder | 2.7% | 4.9% |

The powder characteristics of the embodiment were characterized by industry standard techniques; BET Surface Area Analysis, and Dynamic Laser Scattering (DSL). For the formulations in Table 1 the Single Point Specific Surface Area was 40.31 and 40.36 $m^2/g$ and the particle-size range, 80 nm to 1.2 μm covered both the Minimum and Maximum formulations. Data was measured by a certified testing laboratory, Particle Technology Laboratory, in Downers Grove, Ill.

Figure 2:
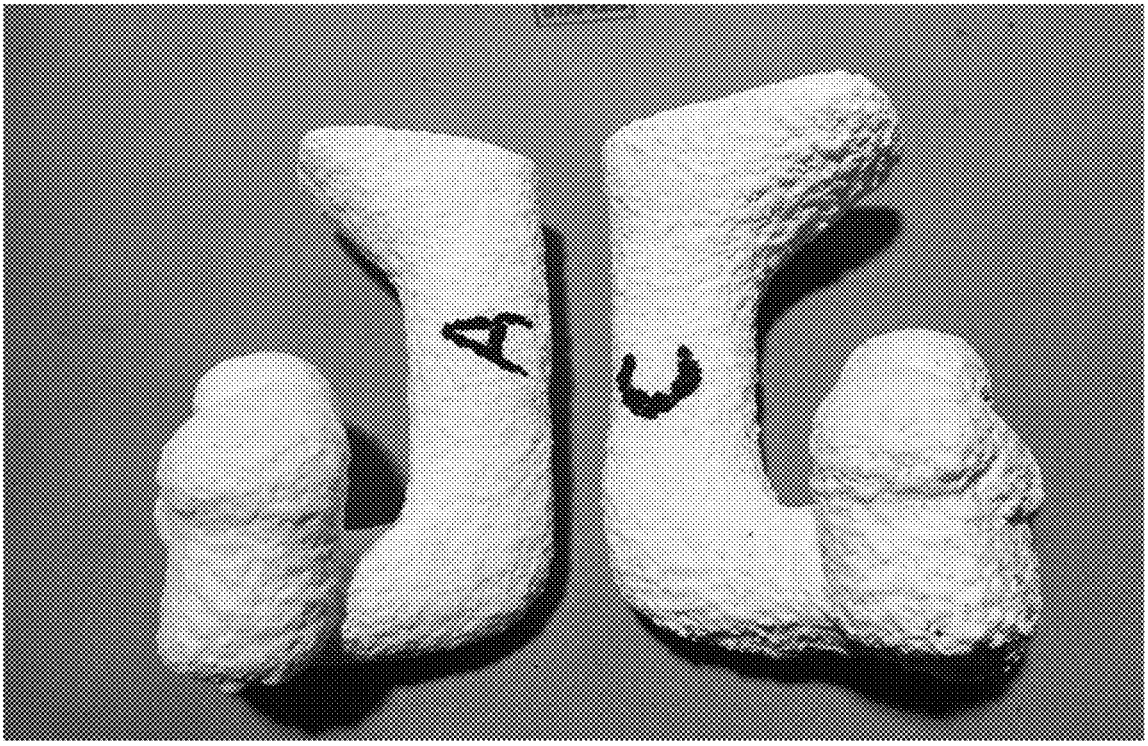
FIG. 2 shows ceramic investment casting molds produced by an embodiment, and by state-of-the-art technology.

FIG. 2 shows ceramic investment casting molds 200 produced by the embodiment (A), and by known state-of-the-art technology (C). Each flash-fired at 815 deg. C.

Table 2 lists the distinctions between the embodiment and state-of-the-art technology.

TABLE 2

| Summary of Mold Manufacture in FIG. 2 | | |
|---|---|---|
| | Powder Binder | State-of-the-art Colloidal Silica |
| Weight Percent Binder in Slurry, 66% total solids in each. | 8% | 38% (as aqueous colloidal silica) |
| Colloidal Binder pH | 4.5 | 10.8 |
| Weight Percent colloidal solids, % | 19.8% | 24.2% |
| Mold fire temperature, 2 hours at temperature | 1,200 deg C. | 1,000 deg. C. |
| Oxide composition in binder | 96% Al2O3, 3% SiO2, and 1% TiO2 | 100% SiO2, trace Na2O |
| Percent Polymer in binder | 2.7% | 1.3% |
| Fired Mold Strength at Room Temperature, 3-pt. MOR, psi | 654 | 300 |

Figure 3:
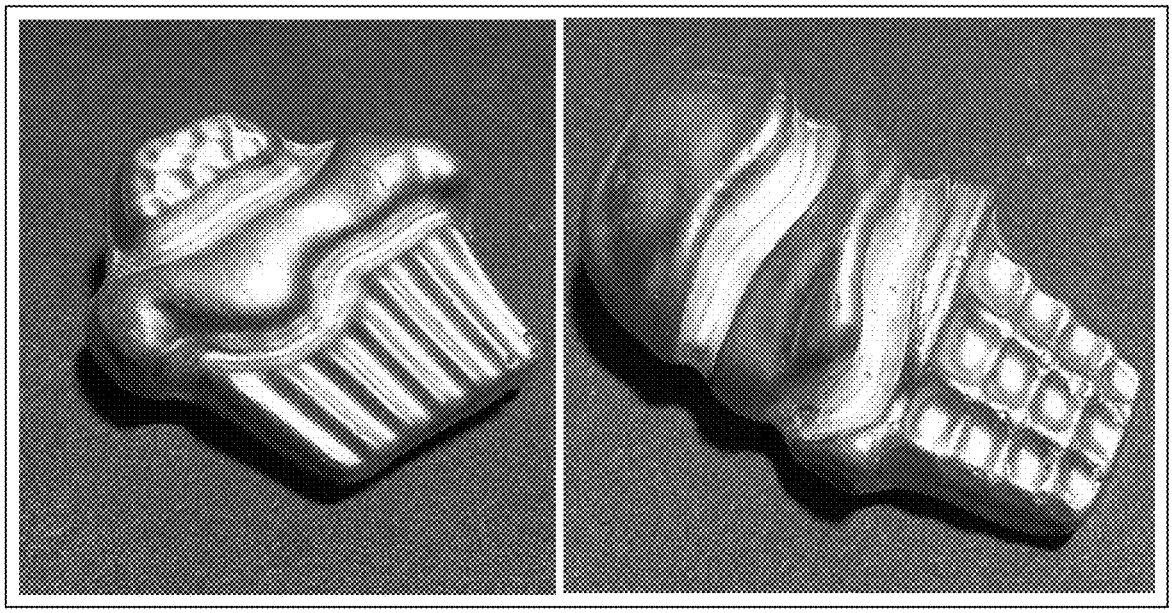
FIG. 3 shows castings manufactured by an embodiment, equivalent in appearance and surface quality to the present state-of-the-art.

FIG. 3 shows A356 aluminum castings 300 manufactured by the embodiment (A), equivalent in appearance and surface quality to the present known state-of-the-art (C).

Figure 4:
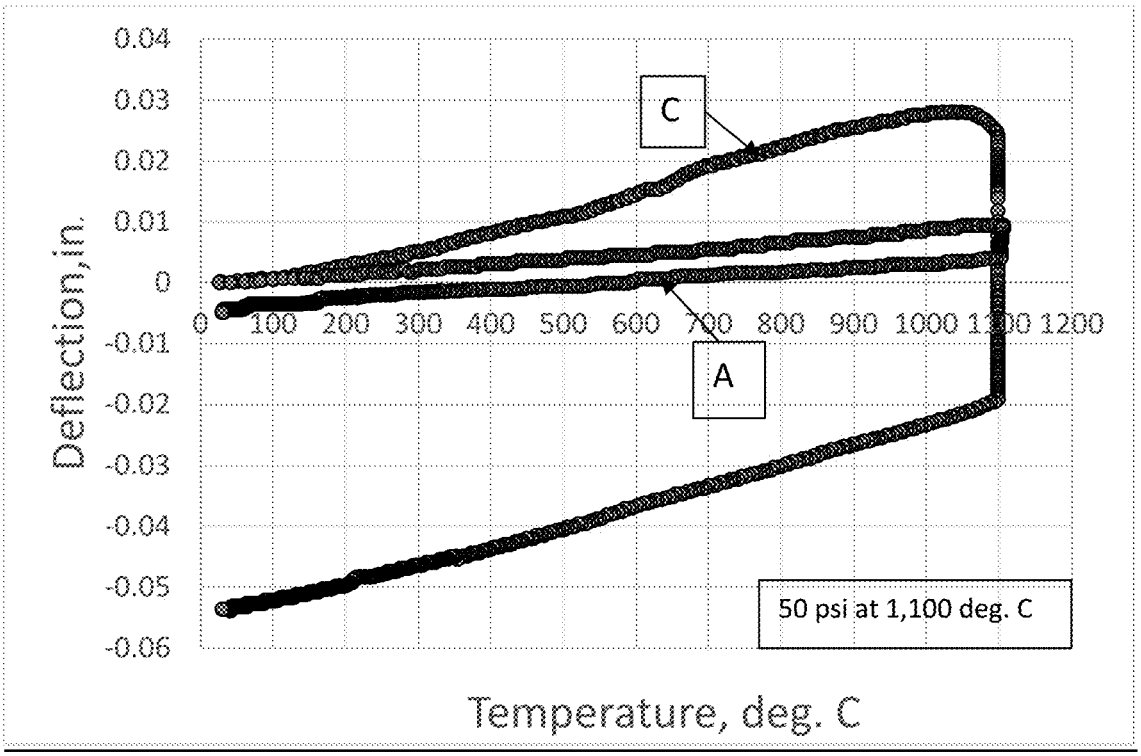
FIG. 4 shows Flexural Creep data of fired shell material by an embodiment, and state-of-the-art colloidal silica.

FIG. 4 Flexural Creep data 400 shows that the embodiment (A) is 10× more resistant to dimensional distortion at high temperature compared to known state-of-the-art colloidal silica (C).

Table 3 shows, after firing at high temperature, the embodiment can consist of up to 96% by weight crystalline aluminum oxide. Colloidal silica under the same conditions consists of 19% non-crystalline glassy phase.

TABLE 3

| Quantitative X-Ray Diffraction Analysis, Calcined Powder Binder, and Colloidal Silica | | | |
|---|---|---|---|
| Phase | Atomic Formula | Powder Binder | SP-30 CS |
| corundum | $Al_2O_3$ | 51.5 | |
| alumina theta | $Al_2O_3$ | 27.9 | |
| alumina | $Al_2O_3$ | 19 | |

TABLE 3-continued

| Quantitative X-Ray Diffraction Analysis, Calcined Powder Binder, and Colloidal Silica | | | |
|---|---|---|---|
| Phase | Atomic Formula | Powder Binder | SP-30 CS |
| kappa alumina | $Al_{2.427}O_{3.64}$ | | |
| eta alumina | $Al_2O_3$ | 1.2 | |
| sigma cristobalite | $SiO_2$ | 0.4 | 11.6 |
| tridymite | $SiO_2$ | | 66.6 |
| quartz | $SiO_2$ | | 0.2 |
| silica | $SiO_2$ | | 2.1 |
| amorphous | Non-crystalline | | 19.5 |

In embodiments, the concentration of the organic polymer comprises between 2.0% and 5.0% of the total dry mass. In embodiments, the organic polymer provides the required mechanical strength associated with dipping, drying, and the mold dewax operation.

Figure 5:
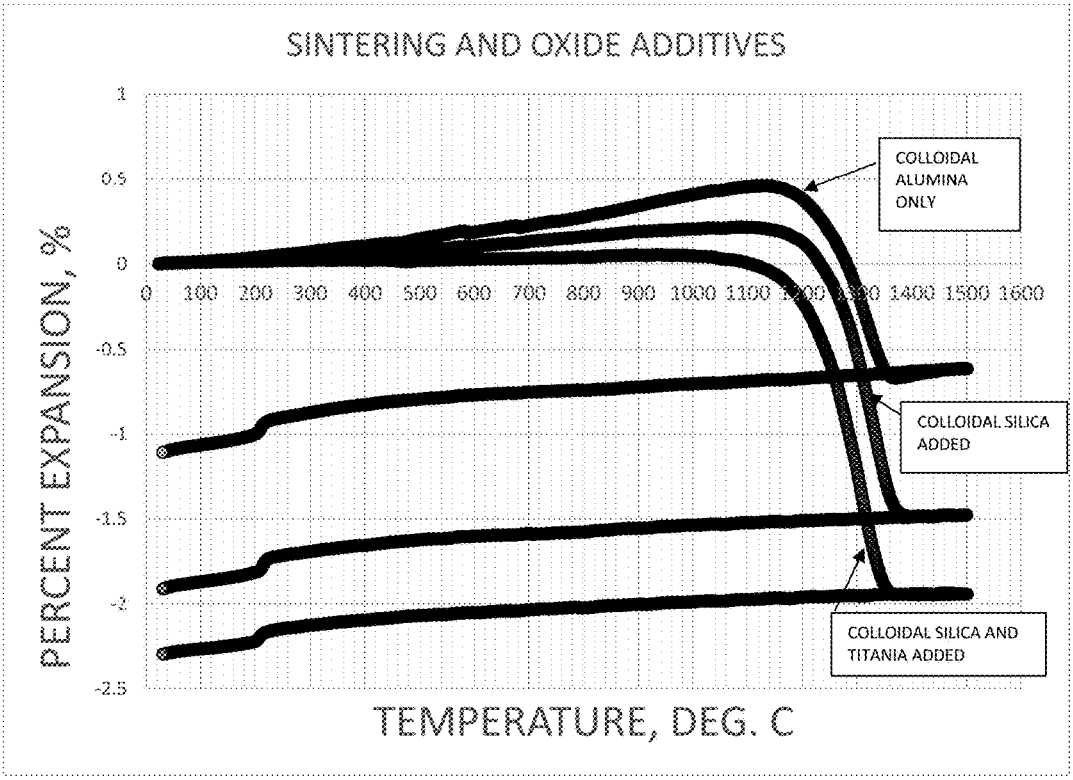
FIG. 5 shows thermal expansion data for firing shell material in accordance with an embodiment.

In embodiments, the powder binder contains titanium oxide, silicon oxide, and aluminum oxide. FIG. 5 shows how, when silicon oxide and titanium oxide are added, the firing temperature for the material decreases 500. In addition, note in Table 4, with the addition of titanium oxide, the mechanical strength of the fired mold material increased two-fold from 242 psi and 267 psi to 660 psi. Furthermore, the 2,000F−2 hrs and 401 psi MOR mechanical strength results, when Silica and Titania are added together, would provide mold properties expected by industry today. This shows the special value of these powder formulations and the special role that titanium oxide plays. Gas permeability, critical in commercial air-melt investment casting, is also shown to increase 25% from 14 and 15 cDarcy to 20 cDarcy with the addition of titanium oxide. This shows that high-alumina powder binder, formulated and fired correctly, yield results useful by industry today but which are not presently commercially available.

TABLE 4

| Mold Properties and Oxide Additives, materials in FIG. 5 | | | |
|---|---|---|---|
| | Colloidal Alumina only | Colloidal Silica Added | Colloidal Silica and Titania added |
| Fired MOR Strength, psi, fired at 2,200 F.-2 hrs | 242 | 267 | 660 |
| Fired MOR Strength, psi, fired at 2,000 F.-2 hrs firing | 70 | 78 | 401 |
| Gas Permeability, cDarcy | 14 | 15 | 20 |

In embodiments, a small amount of wetting agent and anti-foam emulsion is used. A phosphate based wetting agent, Victawet 12, and Dow Corning antifoam 1430 and 1400 are used. Both (initially added to the water) were an asset to disperse the powders and reduce entrapped air. Dilute nitric acid was used to buffer the deionized water, between pH of 3.0 and 4.0, before preparing the slurry.

Mechanical strength is critical at two points in the process; 1) before dewax in the so-called green state, and 2)

after firing before casting to hold liquid metal during casting. During dewax the ceramic and wax assembly is heated rapidly to remove the wax. Before the wax melts it expands and puts a strain and a corresponding stress on the ceramic material it is encased in. If the stress exceeds the mechanical strength of the ceramic in the 'green' state it will crack. Therefore, during investment casting manufacture cracks that form in dewax produce positive metal defects and 'fins' that need to be removed by grinding. If the cracks are excessive the mold may leak and fail completely resulting in scrap and a safety risk to manufacture workers. In this context, the absence of positive metal and 'fins' after casting is evidence of sufficient strength in the green state. As a result, the absence of cracks and 'fins' in FIGS. 2 and 3, is evidence that powder binder in a prime or backup slurry provides sufficient mechanical strength for investment casting.

Mechanical strength in the fired state is also critical to counter the hydrostatic pressure of the liquid metal during casting. A higher mold strength in the fired state is an advantage because the thickness of the mold can be reduced. The increase from 300 to 650 psi with powder binder could be a significant advantage. Money can be saved because less material is needed to produce the mold. Money is also saved by reducing the work space and labor associated with the manufacturing of the ceramic molds. Fewer ceramic raw materials are shipped and the carbon-footprint of manufacturing associated with products is further reduced. A thinner mold can also increase the casting rate of the metal which is known to reduce the grainsize of the metal which in turn increases the mechanical strength and reliability of cast components like turbine blades in aircraft engines.

Furthermore, the dimensional integrity of the mold is also critical both during firing and casting. FIG. 4 shows evidence that, under high temperature and load, the colloidal silica-bonded mold material distorted 0.055 inches and under identical conditions with powder binder, only 0.005 inches with the same aluminosilicate refractory compositions. Significant savings would also be realized from reduced machining, and or straightening due to mold distortion during casting.

Table 3 shows evidence that a greater advantage in dimensional stability could be realized with powder binder from the crystalline aluminum oxide formed and no amorphous phase detected. Casting manufacturers would be able to better meet the dimensional tolerances set by their customers. The X-ray Diffraction Analysis of greater than 95 weight percent is a huge benefit and stands in stark contrast with the 19% amorphous glassy phase with state-of-the-art colloidal silica binder.

Figure 6:
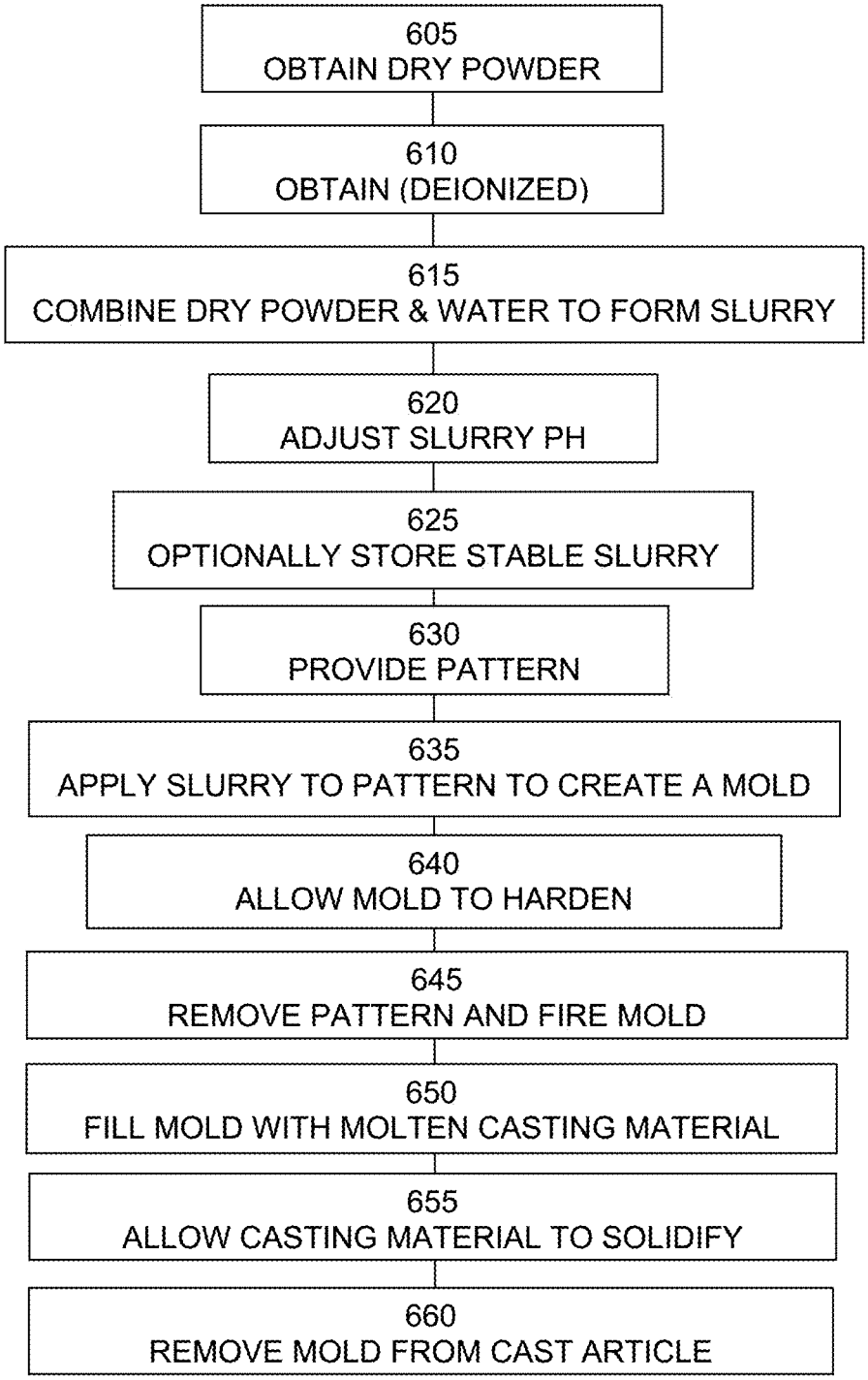
FIG. 6 is a flow chart of a method in accordance with an embodiment.

FIG. 6 is a flow chart of a method 600 for producing an investment casting. Steps of the method comprise: obtaining a dry powder binder (605) comprising fumed alumina, boehmite, fumed silica, or fumed titanium oxide or combinations thereof, and aluminum oxide, zircon, mullite, alumino-silicate, zirconium oxide, yttrium oxide, silicon oxide, and combinations thereof, and a methylcellulose cellulose-based material; obtaining (deionized) water (610) and buffering the deionized water with nitric acid to a pH between about 3.0 and about 5.0; combining the dry powders and the buffered water to form a slurry (615); adjusting pH of the slurry as-needed to an about 3.5 to about 5.0 range (620); providing a pattern (630); applying the slurry with a stucco to the pattern to create a mold (635); allowing the mold to harden (640); removing the pattern from the mold by flash-fire or steam autoclave (645); firing the mold to between 1,000 and 1,200 deg. C; filling the mold with molten casting material (650); allowing the casting material to solidify (655); and removing the mold from a cast article (660).

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure. Other and various embodiments will be readily apparent to those skilled in the art, from this description, figures, and the claims that follow. It is intended that the scope of the invention be limited not by this detailed description, but rather by the claims appended hereto.

What is claimed is:

1. A powder binder product for use in making a slurry for investment casting molds comprising:
- Nano-sized powders; and
- an organic polymer powder;
- wherein the composition of the Nano-sized powder comprises:
  - boehmite or pseudo boehmite, 71% to 94% by weight;
  - aluminum oxide;
  - silicon oxide, 2.5% to 23% by weight;
  - titanium oxide, 0.4% to 1.0% by weight; or
  - combinations thereof; and
- wherein the powder binder product does not comprise aqueous colloidal silica to produce slurries used to build investment casting molds.

2. The powder binder product of claim 1, wherein the composition of the Nano-sized powder comprises:
- pseudo boehmite, 71% to 94% by weight;
- aluminum oxide;
- titanium oxide, 0.4% to 1.0% by weight; or
- combinations thereof.

3. The powder binder product of claim 1, wherein said Nano-sized powder is between 80 nm and 1.2 μm.

4. The powder binder product of claim 1, wherein the organic polymer is between 2.0 and 6.0% by weight of the total powder binder mass.

5. The powder binder product of claim 1, wherein the organic polymer comprises:
- at least one of a cellulose-based material or acrylic combined with polyethylene glycol.

6. The powder binder product of claim 1, wherein the organic polymer comprises:
- a cellulose-based material or acrylic combined with polyethylene glycol; and
- a methyl cellulose binder.

7. The powder binder product of claim 1, which, when fired, comprises:

up to 96 weight percent crystalline aluminum oxide and not less than 70 weight percent.

8. The powder binder of claim 1 for a mold manufacture wherein sizes of particles of a coarse refractory powder are:

-325 mesh;

-200 mesh;

-120 mesh; or combinations thereof.

9. The powder binder product of claim 1 wherein said Nano-sized powder component comprises:

particles less than about 1.2 μm.

10. The powder binder product of claim 1 wherein, when dispersed in deionized water, and buffered to between 3.0 and 5.0 pH, produces an aqueous sol to produce investment casting molds.

11. The powder binder product of claim 1, wherein, once used to produce molds, yields molds subsequently dewaxed by flash-fire.

12. A method for producing an investment casting comprising:

obtaining a dry powder (605) comprising:

fumed alumina, boehmite, 71% by weight to 94% by weight; fumed silica, or fumed titanium oxide, 0.4% by weight to 1.0% by weight, or combinations thereof;

aluminum oxide, zircon, mullite, alumino-silicate, zirconium oxide, yttrium oxide, silicon oxide, 2.5% by weight to 23% by weight, or combinations thereof;

wherein said aluminum oxide, zircon, mullite, alumino-silicate, zirconium oxide, yttrium oxide, silicon oxide, or combinations thereof are added as −325 and −120 flours to make the slurry; and a cellulose-based material;

obtaining water (610) and buffering said water;

combining said dry powder and said buffered water to form a slurry or sol only (615);

adjusting the pH of said slurry (620);

providing a pattern (630);

applying said slurry with a stucco to said pattern to create a mold (635);

allowing said mold to harden (640);

removing said pattern from said mold (645);

filling said mold with molten casting material (650);

allowing said casting material to solidify (655); and removing said mold from a cast article (660).

13. The method of claim 12 wherein said dry powder comprises:

Nano-sized powders; and an organic polymer powder;

wherein the composition of the Nano-sized powder comprises:

boehmite or pseudo boehmite, 71% by weight to 94% by weight;

aluminum oxide;

silicon oxide, 2.5% by weight to 23% by weight;

titanium oxide, 0.4% by weight to 1.0% by weight; or combinations thereof.

14. The method for producing an investment casting of claim 12, wherein said step of obtaining water (610) and buffering said water comprises:

adding nitric acid to a pH between about 3.0 and about 5.0.

15. The method for producing an investment casting of claim 12, wherein said step of adjusting pH of said slurry (620) comprises:

a slurry pH range of about 3.5 to about 5.0 (620).

16. The method for producing an investment casting of claim 12, wherein said step of removing said pattern from said mold comprises:

flash-fire (645).

17. The method for producing an investment casting of claim 12, comprising:

a Nano-sized powder comprising boehmite or pseudo boehmite 71% by weight to 94% by weight, aluminum oxide, silicon oxide, 2.5% by weight to 23% by weight, or titanium oxide, 0.4% by weight to 1.0% by weight, or combinations thereof;

an organic polymer powder; and a coarse refractory powder comprising aluminum oxide, zircon, mullite, alumino-silicate, zirconium oxide, yttrium oxide, fused silicon oxide, or combinations thereof.

18. A method for producing an investment casting comprising:

obtaining a dry powder binder (605) comprising fumed alumina, boehmite, fumed silica, or fumed titanium oxide or combinations thereof, and aluminum oxide, zircon, mullite, alumino-silicate, zirconium oxide, yttrium oxide, silicon oxide, or combinations thereof, and a methylcellulose cellulose-based material;

obtaining (deionized) water (610) and buffering said deionized water with nitric acid to a pH between about 3.0 and about 5.0;

combining said dry powders and said buffered water to form a slurry (615);

adjusting pH of said slurry as-needed to an about 3.5 to about 5.0 range (620);

providing a pattern (630);

applying said slurry with a stucco to said pattern to create a mold (635);

allowing said mold to harden (640);

removing said pattern from said mold by flash-fire (645);

firing said mold to between 1,000 and 1,200 deg C;

filling said mold with molten casting material (650);

allowing said casting material to solidify (655); and removing said mold from a cast article (660).

* * * * *